United States Patent [19]

Hirata et al.

[11] Patent Number: 4,882,516

[45] Date of Patent: Nov. 21, 1989

[54] CATHODE RAY TUBE WITH INTERNAL DOUBLE-WALL MAGNETIC SHIELD

[75] Inventors: Tatsushiro Hirata; Tomohisa Uba, both of Tokyo, Japan

[73] Assignee: Sony Corporation, Tokyo, Japan

[21] Appl. No.: 137,740

[22] Filed: Dec. 24, 1987

[30] Foreign Application Priority Data

Dec. 26, 1986 [JP] Japan ..... 61-316155

[51] Int. Cl.[4] ..... H01J 29/06

[52] U.S. Cl. ..... 313/407; 313/402

[58] Field of Search ..... 313/402, 407; 315/8

[56] References Cited

U.S. PATENT DOCUMENTS 3,867,668 2/1975 Shrader ..... 315/8

4,385,256 5/1983 Tokita et al. ..... 313/407

FOREIGN PATENT DOCUMENTS 0147344 11/1981 Japan ..... 313/402

*Primary Examiner*—Palmer C. DeMeo

*Attorney, Agent, or Firm*—Hill, Van Santen, Steadman & Simpson

[57] ABSTRACT

A cathode ray tube having an internal magnetic shield formed of an inner magnetic plate and an outer magnetic plate which intersect at an acute angle, the distance from the upper terminal end of the inner magnetic plate to the inner surface of the panel, and the distance from the upper end of the outer magnetic plate to the inner surface of the panel being adjusted so as to satisfy a predetermined relationship, thus improving the magnetic shield effect.

4 Claims, 3 Drawing Sheets

CATHODE RAY TUBE WITH INTERNAL DOUBLE-WALL MAGNETIC SHIELD

BACKGROUND OF THE INVENTION

1. Field of the Invention

The present invention is directed to a cathode ray tube having an internal magnetic shield for minimizing the effects of external magnetic fields.

2. Description of the Prior Art

In a cathode ray tube, the phosphor screen must be designed with a tolerance so as to prevent the occurrence of color misregistration even when there is an electron beam mis-landing on the phosphor screen caused by an external magnetic field, such as the earth's terrestrial magnetic field. As the amount which the electron beam mis-lands decreases, the necessary amount of tolerance becomes smaller also and a cathode ray tube of high quality can be manufactured. For this reason, various structures of magnetic shield for use in cathode ray tubes have been proposed in order to reduce the amount of mis-landing of the electron beam due to terrestrial magnetism.

FIG. 1 illustrates an example of a conventional internal magnetic shield used in a cathode ray tube. As illustrated in FIG. 1, this internal magnetic shield 1 is formed of a magnetic plate 3 having a trapezoidal shape along the longer side of a panel 2 of the cathode ray tube and a magnetic plate 5 having a V-shaped groove 4 located along the short side of the panel 2.

A variant of such a magnetic shield has also been proposed such that a magnetic plate of the inner magnetic shield is formed as a hollow double structure in order to improve the shielding effect. This type of structure is disclosed in Japanese Laid-Open Utility Model Application No. 52-42055. This type of magnetic shield, however, does not improve the magnetic shielding effects efficiently since it does not minimize the electron beam mis-landing.

SUMMARY OF THE INVENTION

The present invention seeks to provide a cathode ray tube having an improved internal magnetic shield. The shield is designed to reduce considerably the amount of mis-landing of an electron beam due to terrestrial magnetism.

In one aspect of the present invention, there is provided a cathode ray tube having an inner magnetic shield of a double-walled structure, the inner magnetic shield including the combination of an inner magnetic plate and an outer magnetic plate, the outer magnetic plate being longer than the inner magnetic plate and intersecting the inner plate at an angle of from 5° to 30°. The distance from the upper tip of the inner magnetic plate to the panel, identified as Ha, and the distance from the upper tip of the outer magnetic plate to the panel, identified as Hb, both distances being measured parallel to the vertical axis of the tube, bear the following relationship:

$$1/3 \leqq \frac{Ha}{Hb} \leqq 4/5$$

BRIEF DESCRIPTION OF THE DRAWINGS

Other objects, features and advantages of the invention will become apparent from the following detailed description of the preferred embodiments taken in conjunction with the accompanying drawings, in which.

DESCRIPTION OF THE PREFERRED EMBODIMENTS

Figure 2:
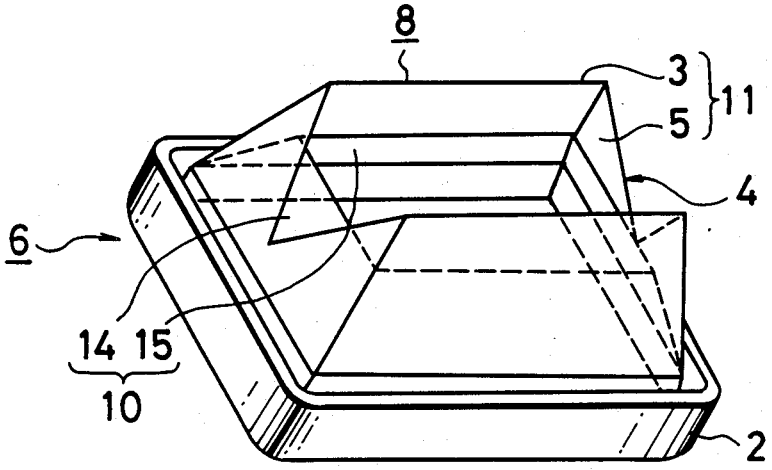
FIG. 2 is a perspective view of one embodiment of a cathode ray tube according to the present invention.
Figure 3:
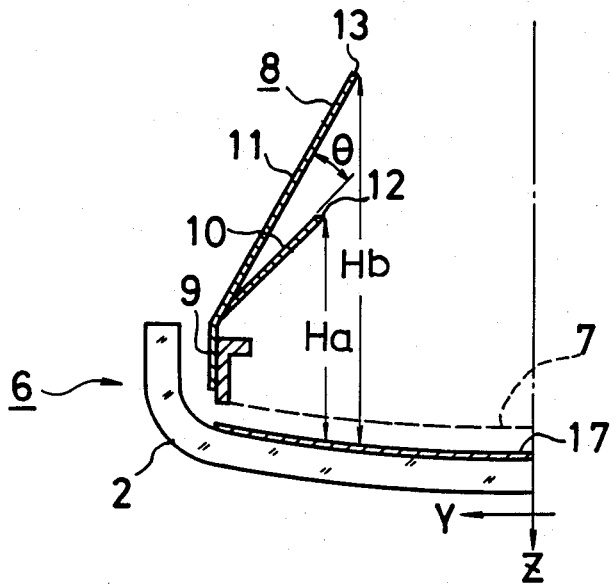
FIG. 3 is a cross-sectional view of the embodiment shown in FIG. 2.

Referring to FIGS. 2 and 3, there is provided an internal magnetic shield 8 within a cathode ray tube. The shield 8 extends away from the screen of the tube 6 and consists of a double structure including an inner magnetic plate or shield portion 10 and an outer magnetic plate or shield portion 11. The intersecting angle $\theta$ between the inner magnetic plate or shield portion 10 and the outer magnetic plate or shield portion 11 should be in the range of about 5° to 30°. This interesting angle is selected to be sufficiently large as long as the large angle does not hinder the impingment of an electron beam upon a phosphor screen 17. For the most improved results, the intersecting angle $\theta$ is about 12°.

If the distance Ha (FIG. 3) measured from the extreme tip or edge of the plate 10 to the screen 17 along a line parallel to the vertical axis of the tube and the dimension Hb measured from the extreme tip wedge of the plate 11 to the screen 17 in the same manner are properly adjusted, the following relationship will be satisfied:

$$1/3 \leqq \frac{Ha}{Hb} \leqq 4/5$$

As shown in FIGS. 2 and 3, in this embodiment of the invention, the internal magnetic shield 8 is mounted to a color selecting electrode such as a shadow mask apertured grill 7 which is attached to a panel 2 of a cathode ray tube 6. The funnel portion, the electron gun, and similar parts of the cathode ray tube are not expressly shown in the drawings. The magnetic shield 8 is integrally formed of a base portion 9 which is fixed to the grill 7. The inner and outer magnetic shield portions 10 and 11 with an intersecting angle, for example, of 12° therebetween extend into the interior of the tube. As in the case of the conventional inner magnetic shield shown in FIG. 1, the outer magnetic shield portion 11 is integrally formed of a trapezoidal shaped magnetic shield portion 3 located along the long side of the panel 2 and a magnetic plate having a V-shaped groove 4 is located along the short side of the panel 2. The inner magnetic shield portion 10 is formed of trapezoidal shaped magnetic plates 14 and 15 located along the short and long sides of the panel 2 as shown in FIG. 2. As shown in FIG. 3, the dimension Ha from the upper end tip 12 of the inner magnetic plate 10 to the inner surface of the panel 2 along a line parallel to the vertical axis of the tube may be about 160 mm and the distance Hb from the upper end tip 13 of the outer magnetic plate 11 to the inner surface of the panel 2 may be 250 mm. With these dimensions, the ratio of the two dimensions is 0.64 so that it is within the equation given.

Figure 5:
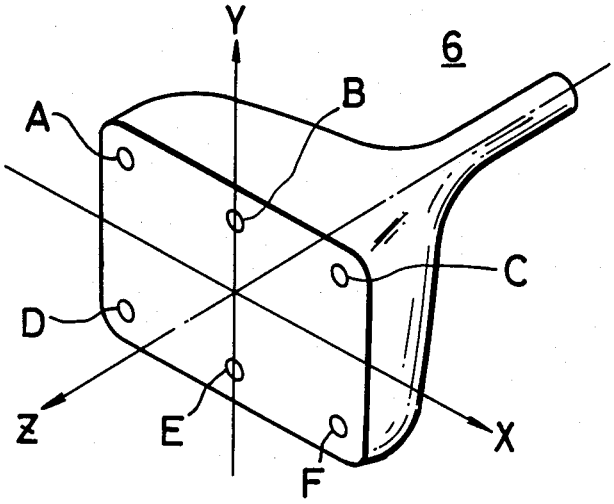
FIG. 5 is a view in perspective of a cathode ray tube used to explain the invention.

Next, cathode ray tube 6 having the inner magnetic shield 8 is supplied as shown in FIG. 5 with an external magnetic field of 0.35 Gauss in the Y-axis direction on the phosphor screen and also a magnetic field of 0.30 Gauss in parallel to the XZ plane. Then, the cathode ray tube 6 is rotated once about the Y-axis. Maximum values of the electron beam mis-landing amounts at points A to F identified on FIG. 5 of the phosphor screen 17 are measured and the measured results are indicated in the following Table 1. The measured values in Table 1 are those which compare the maximum values of the electron beam mis-landing measured similarly in the cathode ray tube 6, using the values obtained in the prior art magnetic shield 1 of FIG. 1 as 100.

TABLE 1

| | B and E | A, C, D and F |
|---|---|---|
| Maximum values of mis-landing | 75 | 100 |

Figure 1:
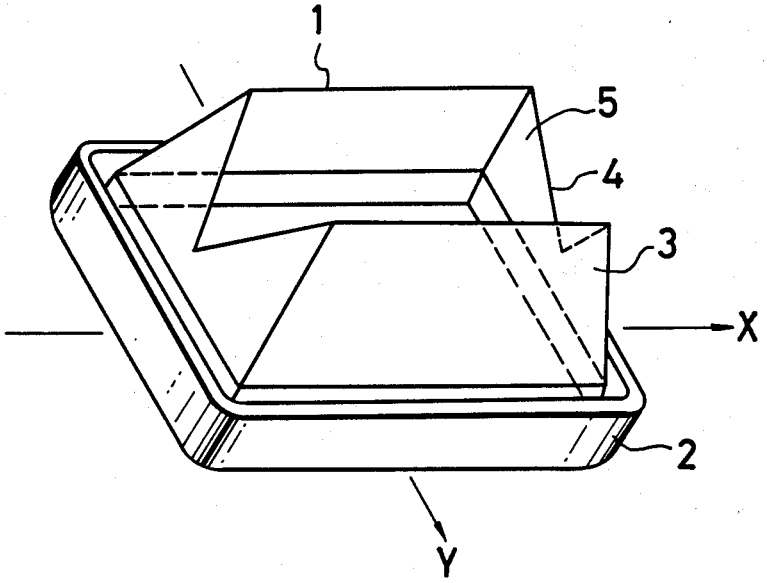
FIG. 1 (PRIOR ART)
FIG. 1 is a perspective view of the conventional cathode ray tube magnetic shielding elements.

As apparent from Table 1, as compared with the conventional structure shown in FIG. 1, the inner magnetic shield 8 of the embodiments shown in FIGS. 2 and 3 can achieve an improvement of the magnetic shield effect of about 25% at points B and E, while the maximum values of the measured amount of electron beam mis-landing are substantially unchanged from those of the prior art at the points A, C, D and F. In other words, unlike the conventional magnetic shield, the shield of this invention can avoid harmful effects in that the magnetic shield effects at the points B and E are improved while the magnetic shield effects at the points A, C, D and F are not deteriorated. The reason that the amount of electron beam mis-landing was measured at the points A to F located around the peripheral portion of the phosphor screen 17 is that the amount of electron beam mislanding is affected considerably by the external magnetic field particularly at peripheral portions of the phosphor screen 17.

Figure 4:
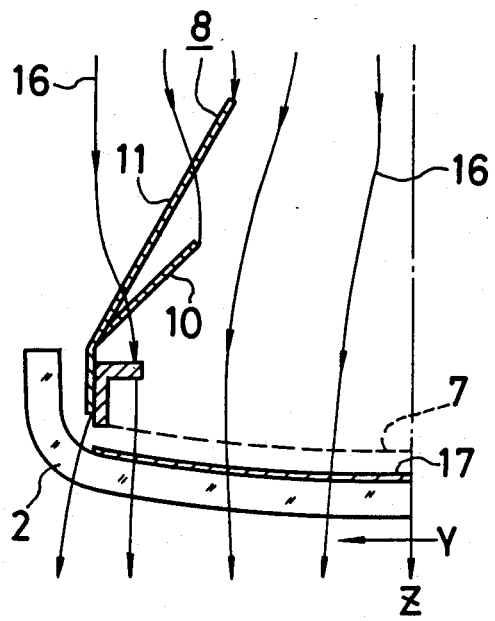
FIG. 4 is another cross-sectional view of the embodiment shown in FIG. 2.
Figure 6:
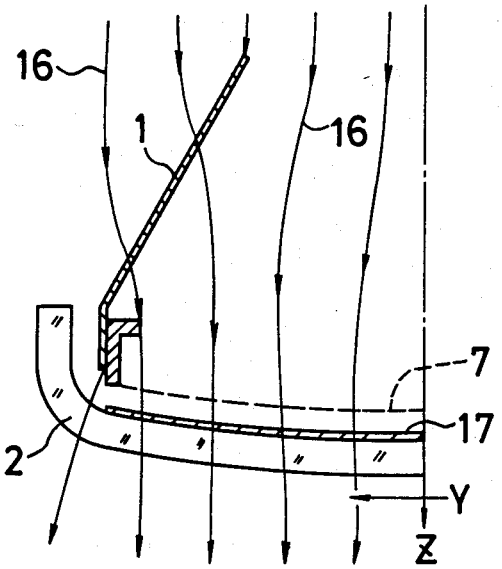
FIG. 6 (PRIOR ART)
FIG. 6 is a cross-sectional view of a conventional cathode ray tube for comparison purposes.

FIG. 4 illustrates a cathode ray tube 6 which employs the panel 2 having the double-structured magnetic shield 8 of the present invention. FIG. 4 is a cross-sectional view of a cathode ray tube on the YZ plane and shows magnetic flux lines 16 when the magnetic field is applied to the cathode ray tube 6 in the Z-axis direction. FIG. 6 is a diagram showing a comparative example of the conventional cathode ray tube which employs the panel 2 provided with a known magnetic shield 1 already described in connection with FIG. 1. FIG. 6 illustrates magnetic flux lines 16 when the magnetic field is applied to the cathode ray tube in the Z-axis direction, as described above. Comparing FIGS. 4 and 6, it will be noted that when a cathode ray tube employs the magnetic shield 8 of the present invention, the influence of the magnetic field within the magnetic shield 8 is weakened so that the mis-landing proportion of the electron beam can be reduced. The magnetic shield 8 is particularly effective for magnetic fields applied in the Z-axis direction at the positions B and E on the cathode ray tube 6 shown in FIG. 5.

Since the magnetic shield effect of the inner magnetic shield is increased with the present invention, it is possible to obtain a cathode ray tube which can reduce the amount of mislanding of the electron beam.

The above description is based on a single preferred embodiment of the invention but it will be apparent that many modifications and variations could be effected by one skilled in the art without departing from the spirit or scope of the novel concepts of the invention so that the scope of the invention should be determined by the appended claims only.

We claim as our invention:

1. In a cathode ray tube having a face panel and an internal magnetic shield positioned adjacent said face panel, wherein the improvement comprises said magnetic shield having an inner shield portion of inner magnetic plates and an outer shield portion of outer magnetic plates, the outer magnetic plates of said outer shield portion being longer than the inner magnetic plates of the inner shield portion and intersecting the inner magnetic plates at an angle in a range of 5° to 30°, each of said inner and outer magnetic plates having an upper edge and said magnetic shield having the following relationship: $\frac{1}{3} \leqq Ha/Hb \leqq 4/5$, wherein Ha is the distance from the upper edge of said inner magnetic plate from said panel, and Hb is the distance from the upper edge of said outer magnetic plate from said panel, both distances being measured parallel to a vertical axis of said tube.

2. In a cathode ray tube according to claim 1, wherein said angle is about 12°.

3. In a cathode ray tube having a rectangular front panel with a phosphorous screen with two long sides and two short sides, a shadow mask supported on a frame positioned adjacent the screen, and an internal magnetic shield mounted on the frame of the shadow mask, wherein the improvement comprises the internal magnetic shield being a double-wall shield having a base mounted to the frame with an inner plate and an outer plate extending therefrom on each side of the frame, each of the outer plates being longer than the inner plates, the inner and outer plates intersecting at the base at an angle in a range of 5°–30°, all of said inner plates having a trapezoidal shape, two of the outer plates associated with the longer sides of the front panel having a trapezoidal shape, and two of the outer plates associated with the two shorter sides of the front panel having a V-shaped groove.

4. In a cathode ray tube having a rectangular front panel with a phosphorous screen, a shadow mask supported on a frame positioned adjacent the screen, and an internal magnetic shield mounted on the frame of the shadow mask, wherein the improvement comprises the internal magnetic shield being a double-wall shield having a base mounted to the frame with an inner plate and an outer plate extending from the base and away from said front panel on each side of the frame, each of the outer plates being longer than the inner plates and the inner and outer plates intersecting at the base at an angle in a range of 5°–30°, each of the inner plates having an upper edge with a distance Ha from the panel, each of said outer plates having an upper edge with a distance Hb from the panel, said distances having the following relationship: $\frac{1}{3} \leqq Ha/Hb \leqq 4/5$ and said distances being measured parallel to the vertical axis of said tube.

* * * * *